US007179000B2

(12) United States Patent
Takasu et al.

(10) Patent No.: US 7,179,000 B2
(45) Date of Patent: Feb. 20, 2007

(54) METHOD OF DEVELOPING A RESIST FILM AND A RESIST DEVELOPMENT PROCESSOR

(75) Inventors: Hisayuki Takasu, Higashiibaraki (JP); Kouichi Miyazawa, Mito (JP); Toru Iwaya, Hitachiota (JP)

(73) Assignee: Hitachi Science Systems, Ltd., Ibaraki (JP)

( * ) Notice: Subject to any disclaimer, the term of this patent is extended or adjusted under 35 U.S.C. 154(b) by 0 days.

(21) Appl. No.: 11/359,483

(22) Filed: Feb. 23, 2006

(65) Prior Publication Data

US 2006/0140624 A1 Jun. 29, 2006

Related U.S. Application Data

(62) Division of application No. 10/705,845, filed on Nov. 13, 2003, now Pat. No. 7,033,089.

(30) Foreign Application Priority Data

Nov. 19, 2002 (JP) ..... 2002-334781

(51) Int. Cl.
*G03D 5/00* (2006.01)

(52) U.S. Cl. ..... 396/611

(58) Field of Classification Search ..... None
See application file for complete search history.

(56) References Cited

U.S. PATENT DOCUMENTS 4,944,837 A * 7/1990 Nishikawa et al. ..... 216/41
5,185,296 A 2/1993 Morita et al.
5,304,515 A 4/1994 Morita et al.
6,286,231 B1 * 9/2001 Bergman et al. ..... 34/410
6,358,673 B1 3/2002 Namatsu
6,554,507 B2 * 4/2003 Namatsu ..... 396/611
6,926,798 B2 * 8/2005 Biberger et al. ..... 156/345.31
2002/0132192 A1 9/2002 Namatsu
2004/0096210 A1 5/2004 Takasu et al.
2004/0123484 A1 7/2004 Yoshikawa et al.
2004/0198066 A1 10/2004 Verhaverbeke
2005/0008980 A1 1/2005 Arena-Foster et al.
2005/0191861 A1 * 9/2005 Verhaverbeke ..... 438/745

FOREIGN PATENT DOCUMENTS

JP 1-220828 9/1989
JP 2-35458 2/1990
JP 7-284739 10/1995
JP 9-139374 5/1997
JP 11-87306 3/1999
JP 2000-91180 3/2000
JP 2003-122024 4/2003

OTHER PUBLICATIONS

Statement explaining the revelance of the cited references.

* cited by examiner

*Primary Examiner*—D. Rutledge
(74) *Attorney, Agent, or Firm*—Dickstein Shapiro LLP

(57) ABSTRACT

The present invention provides a resist development processor consisting of a development processing chamber for storing a resist substrate having an exposed resist on the substrate and for developing the exposed resist by means of a development solvent consisting of a supercritical fluid; and a supercritical fluid container for storing a supercritical fluid, where the supercritical fluid container is connected to the development processing chamber through a valve.

3 Claims, 6 Drawing Sheets

METHOD OF DEVELOPING A RESIST FILM AND A RESIST DEVELOPMENT PROCESSOR

CROSS-REFERENCE TO RELATED APPLICATIONS

This application is a divisional of U.S. patent application Ser. No.: 10/705,845, filed on Nov. 13, 2003 now U.S. Pat. No. 7,033,089 which is incorporated herein by reference.

BACKGROUND OF THE INVENTION

1. Field of the Invention

The present invention relates to a method of developing a resist film formed on a substrate such as an LSI, a method of surface treatment of the resist film, a development processor for the resist, and a surface processor.

2. Related Art

The following publications show related art of the present invention.

(1) Patent Document 1; Japanese Patent Laid-Open Publication No. 07-284739 (1995)

(2) Patent Document 2; Japanese Patent Laid-Open Publication No. 09-139374 (1997)

(3) Patent Document 3; Japanese Patent Laid-Open Publication No. 11-87306 (1999)

(4) Patent Document 4; Japanese Patent Laid-Open Publication No. 2001-220828

In manufacturing a large-scale, high-integration density and high-performance device, a resist film, which is formed on a silicon wafer is exposed, developed, rinsed and dried to form a pattern thereon. Then, a process comprising steps of etching the silicon through the pattern, rinsing and drying is carried out to manufacture the above-mentioned device. In the specification, the resist is defined as the polymer material sensitive to light, X-ray, electron beam or the like.

A special-purpose processing apparatus is required in each of these steps. Further, since chemical solutions such as a developer and a rinser have been used in development, rinsing and cleaning processes, a drying step is essential after the rinsing and cleaning steps.

Patent Document 1 discloses a rinsing apparatus for rinsing such micromachined parts as a semiconductor and liquid crystal display where a rinsing medium in the supercritical state is used.

Patent Document 2 shows a method of rinsing with a supercritical fluid in the step of forming a microscopic structure or production of a semiconductor device.

Patent Document 3 describes a drying apparatus using a supercritical fluid in the production of a semiconductor device.

Patent Document 4 indicates a method for forming the pattern of a resist by development using a supercritical fluid.

Patent Documents 1 through 3 disclose rinsing and drying with a supercritical fluid, but fail to show development of the substrate having an exposed resist, using the supercritical fluid.

The present inventors have found out the following problems in the above-mentioned drying process:

(1) The pattern collapse may be caused by the action of surface tension of the above-mentioned chemical solution remaining in the pattern formed in the resist film.

(2) When, in order to prevent the pattern from collapse, a drying method using the supercritical carbon dioxide is used in the drying process for reducing the surface tension acting on the pattern, water remaining in the pattern cannot be completely removed even if the supercritical carbon dioxide is used as the drying agent, subsequent to alkali development and water rinsing. The prior art method cannot prevent the pattern from collapse. For this reason, the present inventors have found it difficult to use the drying method using the above-mentioned supercritical fluid.

The present inventors have also found out the following problems: In the development of the resist film having a microscopic structure with the supercritical fluid as shown in Patent Document 4, carbon dioxide is introduced into the development processing chamber by heating the development processing chamber. As the heat capacity of the chamber becomes larger, the time period for reaching the temperature to the set level, which is above the critical temperature at which the intended dissolution power is exhibited is prolonged. That is, the intended dissolution power becomes equal to the development conditions. This leads to the failure to obtaining a satisfactory result. Especially when a plurality of large-diameter resist films each having a diameter of 200 mm or more are developed, some of the resist films touch the liquid carbon dioxide when it is introduced. This results in phenomena that are beyond the control, thereby causing fluctuations in development.

SUMMARY OF THE INVENTION

An object of the present invention is to provide a method of developing a resist film, a method of treating a surface of a resist film carried on a substrate such as silicon wafer, a resist development processor, and a surface processor that permits microscopic development of the resist film in a short period of time with the minimum fluctuation and maximum accuracy, using such a supercritical fluid as carbon dioxide that eliminates the need of utilizing a chemical solution and a waste liquid treatment facility.

The present inventors have found out an apparatus and the method for utilizing the same that ensures quick development of an exposed resist film with a supercritical fluid in the aforementioned process, using supercritical carbon dioxide, so as to eliminate the possibility of pattern collapse or the need of using a chemical developer or rinser. The aforementioned apparatus and method can carry out a pattern forming process by removing the photo-exposed resist film or the non photo-exposed portion in the phase of development.

Dissolution power of the solvent for a solute depends on the temperature and density of the solvent. When a solvent is used as a developer of the resist film, the solvent as a developer may be beyond the critical point, i.e. the supercritical state under the condition for getting dissolution power suitable for developing the resist film. The density of the supercritical fluid can be changed by controlling its pressure and temperature; as a result, its dissolution power can be controlled freely.

The supercritical fluid has the similar degree of diffusion power to that of gas, and can be changed from liquid to gas, without passing through the vapor-liquid equilibrium line. To put it another way, fluid pressure is controlled below the critical level while the temperature of the fluid is kept above the critical temperature, whereby the fluid is changed from liquid to gaseous state. This change of the state does not bring about action of the surface tension.

Such a substance as carbon dioxide that changes into gas at the normal temperature and atmospheric pressure and that has a relatively low critical pressure and temperature is suitable as a supercritical fluid for developing the resist film having a microscopic pattern. Carbon dioxide has a critical temperature of 31 degrees Celsius and a critical pressure of 7.3 MPa. A resist film made of fluorine-containing polymeric material that can be solved in liquid carbon dioxide or supercritical carbon dioxide is suitable as the solvent for the resist film.

When carbon dioxide as development solvent is in the gaseous state, density is lower than the liquid carbon dioxide and supercritical carbon dioxide. Accordingly, dissolution power is extremely small. Thus, the development effect on the resist film is available only when carbon dioxide as development solvent is in the supercritical or liquid state.

To be more specific, when the development processing chamber with a resist substrate placed therein is filled with carbon dioxide in the liquid or supercritical state, the resist is developed. If the carbon dioxide filling the development processing chamber is changed into gas, resist development is discontinued because the resist is not dissolved. To put it another way, the time when the development processing chamber is filled with carbon dioxide in the liquid or supercritical state is equal to the resist development time.

Resist development by supercritical carbon dioxide is carried out as follows: A resist substrate, coated with such a resist as a fluorine-containing polymeric material that can be dissolved in carbon dioxide, is exposed and installed in a development processing chamber. Then development processing chamber is filled with supercritical carbon dioxide, and the solubility of supercritical carbon dioxide with respect to fluorine-containing polymeric material is utilized for resist development by supercritical carbon dioxide.

Development is discontinued by discharging the supercritical carbon dioxide from the development processing chamber and reducing the pressure inside the development processing chamber, thereby converting carbon dioxide in a gaseous state. Further, when the atmospheric pressure has been reached by discharging carbon dioxide from the development processing chamber, the resist substrate is taken out of the development processing chamber to terminate the process of development.

The solubility of carbon dioxide with respect to fluorine-containing polymeric material is about the same as that of hexane. Especially when developing a plurality of large-diameter resist substrates having a diameter of 200 mm or more, a large quantity of supercritical carbon dioxide is required. The high pressure container serving as a development processing chamber is required to have a sufficient volume to accommodate the amount of supercritical carbon dioxide needed for development. This leads to an increase in the size of the development processing chamber and heat capacity.

The carbon dioxide serving as a development solvent is introduced into the development processing chamber from a siphon-based liquid carbon dioxide container in the liquid form. Then the development processing chamber is controlled to have the set temperature above the critical temperature, to ensure that carbon dioxide is converted from liquid to supercritical state. Rise of temperature is accompanied by rise of pressure. The pressure in the development processing chamber is held to the set level of not less than the critical pressure, by the back pressure regulator.

When carbon dioxide is introduced from the siphon-based liquid carbon dioxide container into the development processing chamber, liquid carbon dioxide is led into the development processing chamber until both pressures are equal to each other. In this case, if the percentage of the liquid carbon dioxide filling the development processing chamber is below 50%, the supercritical state cannot be reached even if the temperature in the development processing chamber is raised over the critical temperature.

The percentage of liquid carbon dioxide in the development processing chamber depends on the characteristics of carbon dioxide. Accordingly, when the temperature of the siphon-based liquid carbon dioxide container is controlled so as to exceed 25 degrees Celsius, then the internal pressure will be at least 6 MPa. If the temperature in the development processing chamber is controlled to reach the level of about 20 degrees Celsius, then the percentage of the liquid carbon dioxide filling the development processing chamber will reach about 80%. If the temperature in the development processing chamber is raised to about 35 degrees Celsius under this condition, the chamber will be filled with supercritical carbon dioxide of about 10 MPa.

For the aforementioned reasons, the temperature in the development processing chamber must be controlled to reach the level of 20 degrees Celsius when liquid carbon dioxide is introduced into the development processing chamber. Thus, a large quantity of heat must be supplied when the temperature of the development processing chamber having a sufficient volume to develop a plurality of large-diameter resist substrates having a diameter of 200 mm or more is raised above the critical temperature. This will require a long time, as shown in FIG. 2. The control time from introduction of liquid carbon dioxide to the arrival to the set temperature level can be simply calculated from the heat capacity of the high pressure container, the capacity of the heater and heat transfer efficiency. It is apparent that a smaller heat capacity of the development processing chamber leads to less time to change the carbon dioxide filling the development processing chamber from liquid to supercritical state. However, this involves an increase in the heat capacity of the development processing chamber. This problem and the problems involved in the development of a plurality of large-diameter resist substrates having a diameter of 200 mm or more are solved by the following apparatus and the method for the same:

The present invention provides a resist development apparatus comprising:

a development processing chamber for storing a resist substrate having an exposed resist on the substrate and for developing the exposed resist by means of a development solvent consisting of a supercritical fluid; and a supercritical fluid container for storing a supercritical fluid, this supercritical fluid container being connected to this development processing chamber through a valve. The present invention is further characterized by containing:

a high pressure gas container for storing a high pressure gas, this high pressure gas container being connected to this development processing chamber through a valve; and a liquid container for storing the liquid liquefied by high pressure, this liquid container being connected through a valve.

To be more specific, the present invention provides a resist development processor that utilizes the solubility of a supercritical fluid introduced into the development processing chamber where an exposed resist substrate is installed. It is characterized in that supercritical fluid is filled into a supercritical fluid container connected by a pipe to the development processing chamber through a valve; and the development processing chamber is filled with the supercritical fluid of a predetermined density and temperature when the valve is opened. It is preferred that the present invention be equipped with:

a back pressure regulator wherein the high pressure container connected by a pipe to this development processing chamber through a valve is filled with high-pressure development solvent, and supercritical fluid having filled the development processing chamber is converted into gaseous state without being liquefied, when the valve is opened;

a temperature regulator for ensuring that, when the high pressure gas filling the aforementioned resist development processing chamber is discharged, it can be discharged while the gas temperature in the resist development processing chamber is controlled so as to exceed the critical point, whereby gas is discharged from the resist development processing chamber without being liquefied;

holding means that, when liquid serving as a development solvent is introduced into the aforementioned development or when the pressure of the resist development processing chamber is boosted, prevents the liquid development solvent from coming into contact with the resist substrate;

a high pressure force supply pump that pumps liquid development solvent into the aforementioned resist drying chamber; and a temperature regulator for regulating so as to minimize the difference in the temperatures of the aforementioned development solvents supplied into the aforementioned development processing chamber from each container.

The present invention also provides a resist development processing method for performing development by direct introduction of development solvent consisting of supercritical fluid into a resist substrate having an exposed resist on the substrate.

The present invention also provides a resist development processing method characterized by comprising the steps of:

introducing the supercritical fluid into the development processing chamber for storing a resist substrate having an exposed resist on the substrate;

introducing the liquid of the same material as that of the aforementioned fluid into the aforementioned development processing chamber; and removing the aforementioned supercritical fluid from the development processing chamber.

To put it more specifically, the present invention provides a resist development processing method wherein development is performed by introduction of the development solvent consisting of supercritical fluid into a development processing chamber for storing a resist substrate having an exposed resist on the substrate. This resist development processing method is characterized by comprising the steps of:

filling the development processing chamber with the development solvent without contacting the resist substrate;

introducing the supercritical fluid into the development processing chamber;

pumping the development solvent in a liquid state into the development processing chamber; and removing the supercritical fluid with the temperature of gas in the development processing chamber maintained above the temperature of critical point, without allowing the supercritical fluid to be liquefied.

The present invention further provides a resist development processing method comprising the steps of:

introducing liquid carbon dioxide into a development processing chamber for storing a resist substrate having an exposed resist and holding the resist substrate to the aforementioned gaseous carbon dioxide;

introducing supercritical carbon dioxide into the aforementioned development processing chamber and maintaining it at a specified pressure, thereby allowing the aforementioned development to be carried out;

pumping liquid carbon dioxide into the aforementioned development processing chamber and mixing it with the aforementioned supercritical carbon dioxide;

discharging the supercritical carbon dioxide of the aforementioned development processing chamber into a high pressure carbon dioxide container filled with high pressure gaseous carbon dioxide, and converting the supercritical carbon dioxide filling the aforementioned development processing chamber into gaseous form, thereby stopping the process of development; and removing carbon dioxide of the aforementioned development in the gaseous state.

In the method according to the present invention, the temperature of the development solvent into the development processing chamber is adjusted in such a way that changes in the temperature of the resist substrate in the aforementioned development processing chamber do not exceed 10 degrees Celsius, preferably, 5 degrees Celsius.

The present invention further provides a surface processor comprising:

a processing chamber for storing an object to be processed;

a supercritical fluid container for storing a supercritical fluid where this supercritical fluid container is connected to the processing chamber through a valve;

a high pressure gas container for storing the high pressure gas of the same material as that of the aforementioned fluid where the high pressure gas container is connected to the aforementioned processing chamber through a valve; and a liquid container for storing a liquid of the same material as that of the aforementioned fluid where the liquid container is connected through a valve.

The present invention further provides a surface processing method comprising the steps of:

introducing the supercritical fluid filled in the supercritical fluid container, into the processing chamber for storing an object to be processed;

introducing into the aforementioned processing chamber the liquid of the same material as that of the aforementioned fluid filled in the liquid container; and discharging the supercritical fluid of the processing chamber into the high pressure gas container filled with high pressure gas.

The resist development apparatus and the method thereof, using supercritical fluid according to the present invention, ensures precise control of the solubility of a supercritical fluid as a development solvent. In the formation of a minute pattern having a resist width of 100 nm through 20 nm (for future), this invention permits development of the resist pattern without variation where high-performance characteristics are required. Alternatively, the surface processor and the method thereof allow quick processing in the phase of cleaning and drying, separately from the aforementioned development, and are capable of meeting the requirements in minute pattern formation.

DETAILED DESCRIPTION OF THE INVENTION

Description of the Preferred Embodiments

Figure 1:
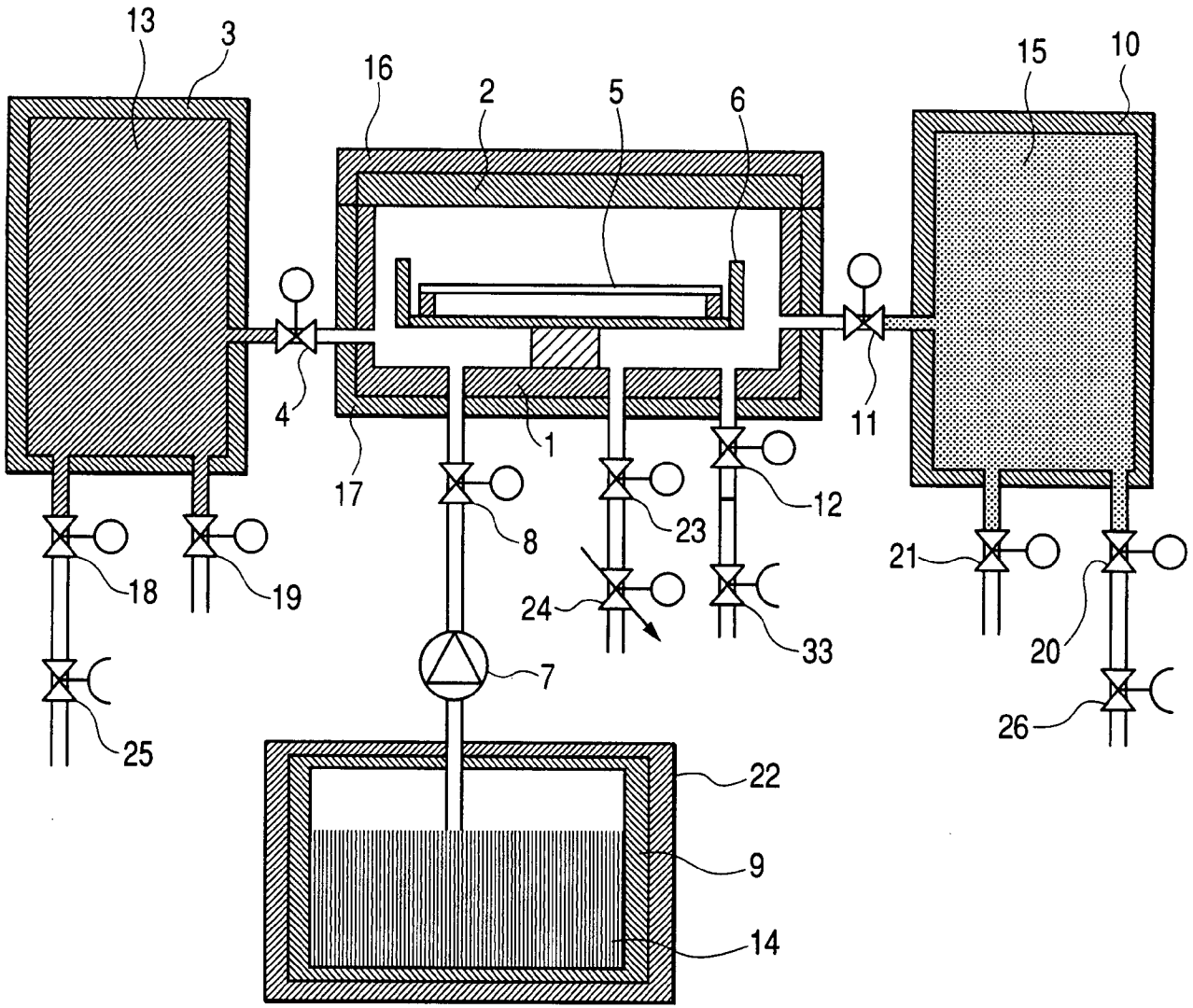
FIG. 1 is a block diagram representing a resist development apparatus according to the present invention.

FIG. 1 is a block diagram representing a supercritical resist development apparatus according to the present invention. A supercritical carbon dioxide container 3 filled with supercritical carbon dioxide 13 at a pressure of 20 MPa and a temperature of 40 degrees Celsius is connected through a valve 4 to the development processing chamber 1 controlled to have a temperature of 30 degrees Celsius. After a resist substrate 5 coated with exposed fluorine-containing polymeric material has been installed in the substrate holder 6 inside the development processing chamber 1, the development processing chamber 1 is enclosed with a cover 2. The valves 4, 8, 11, 12 and 23 connected to the development processing chamber 1 are closed and a valve 20 connected to the high pressure carbon dioxide gas container 10 is opened.

When the siphon-based liquid carbon dioxide container 9 is controlled to 25 degrees Celsius by the temperature regulator 22, the internal pressure can be set to 6 MPa because of the characteristics of carbon dioxide. If the valve 8 is opened, liquid carbon dioxide 14 is introduced into the development processing chamber 1 from the siphon-based liquid carbon dioxide container 9. If the pressure of the development processing chamber 1 has reached the same pressure of the siphon-based liquid carbon dioxide container 9, the valve 8 is closed. Since the development processing chamber 1 is controlled to 36 degrees Celsius, the liquid carbon dioxide introduced is turned into gas because of the characteristics, and the development processing chamber is filled with gas carbon dioxide having a pressure of 6 MPa and a temperature of 36 degrees Celsius.

The supercritical carbon dioxide container 3 filled with supercritical carbon dioxide 13 having a temperature of 40 degrees Celsius and a pressure of 20 MPa is connected to the development processing chamber 1 through a valve 4. When the valve 4 is opened, the supercritical carbon dioxide 13 is introduced into the development processing chamber 1 and the development processing chamber 1 is filled with supercritical carbon dioxide having a pressure of 14 MPa and a temperature of 38 degrees Celsius, thereby allowing the development of the resist substrate 5 to be started.

When the pressure of the development processing chamber 1 has become equal to that of the supercritical carbon dioxide container 3, the valve 4 is closed. In this case, even if supercritical carbon dioxide filling the development processing chamber 1 has dissolved the resist, solubility is kept constant without changing. Accordingly, the valve 8 has opened, and the liquid carbon dioxide 14 is pumped into the development processing chamber 1 by the high pressure force supply pump 7 at the rate of 50 ml per minute. The liquid carbon dioxide introduced into the development processing chamber 1 is turned into supercritical state by heat transfer and is mixed with supercritical carbon dioxide filling the development processing chamber 1.

The valve 12 opens concurrently as the pumping of liquid carbon dioxide has started the high pressure force supply pump 7. When liquid carbon dioxide is pumped by the high pressure force supply pump 7, the pressure of the development processing chamber 1 is boosted. However, it is discharged by the back pressure regulator 33 set at 14 MPa, and the development processing chamber 1 is held to a set pressure of 14 MPa. After liquid carbon dioxide has been pumped by the high pressure force supply pump 7 for 200 seconds, the valve 8 is closed to discontinue pumping.

To discontinue development, the state of carbon dioxide filling the development processing chamber 1 is changed into gas. The high pressure carbon dioxide gas container 10 filling the carbon dioxide gas 15 having a temperature of 36 degrees Celsius and a pressure of 4 MPa is connected to the development processing chamber 1 through the valve 11. When the valve 11 is opened for a short time, supercritical carbon dioxide filling the development processing chamber 1 is discharged into the high pressure carbon dioxide gas container 10. Supercritical carbon dioxide filling the development processing chamber 1 is changed into gas having a pressure of 6 MPa and a temperature of 35 degrees Celsius, whereby development is stopped. In this case, the pressure of the high pressure carbon dioxide gas container 10 is boosted by the supercritical carbon dioxide introduced, but the gas is discharged from the back pressure regulator 26 and the pressure is maintained to 4 MPa.

When development has been discontinued, the carbon dioxide filling the development processing chamber 1 is discharged. The valve 23 is opened to discharge carbon dioxide from the pressure control valve 24. When it is discharged, the development processing chamber is controlled to a temperature of 36 degrees Celsius above the critical temperature in such a way that carbon dioxide filling the development processing chamber 1 is not be liquefied.

When the pressure in the development processing chamber 1 has reached the atmospheric pressure, the development processing chamber cover 2 is opened to take out the resist substrate 5.

Figure 4:
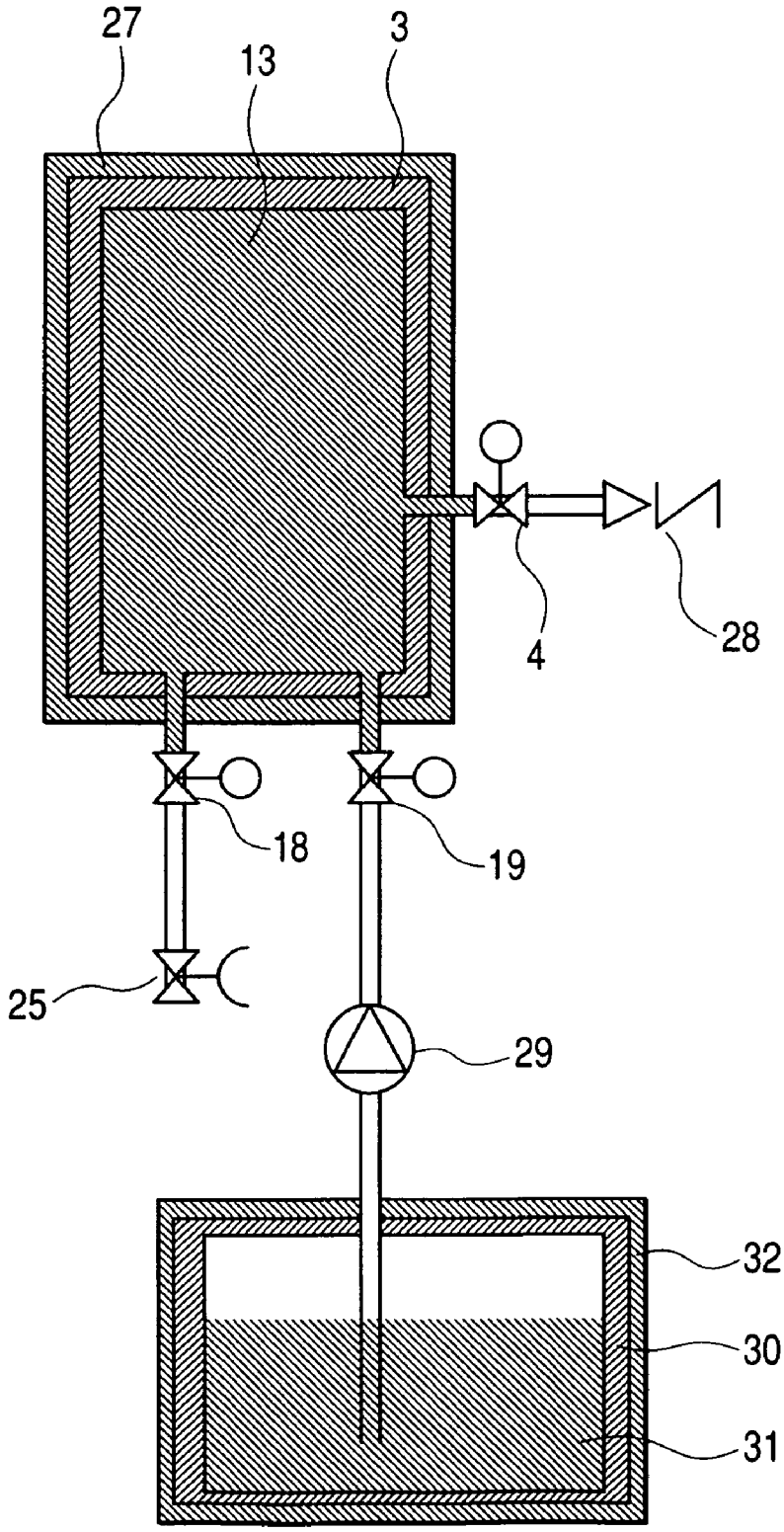
FIG. 4 is a block diagram of a resist development apparatus of the present invention, representing connection between a supercritical carbon dioxide container and a liquid carbon dioxide.

FIG. 4 is a cross section representing part of the configuration of a resist development apparatus for filling the supercritical carbon dioxide container with supercritical carbon dioxide, according to the present invention. The supercritical carbon dioxide container 3 is controlled to 20 degrees Celsius by a temperature regulator 27. A siphon-based liquid carbon dioxide container 30 is installed separately from the siphon-based liquid carbon dioxide container 9 given in FIG. 1. The temperature is controlled to about 25 degrees Celsius by a temperature regulator 32. When valves 4 and 18 are closed and valve 19 is opened, the liquid carbon dioxide 31 is introduced into the supercritical carbon dioxide container 3. When the pressure of liquid carbon dioxide container 30 has become equal to that of the supercritical carbon dioxide container 3, the valve 18 is opened and the liquid carbon dioxide 31 is pumped into the supercritical carbon dioxide container 3 by a high pressure force supply pump 29. Concurrently as pumping of the high pressure force supply pump 29 has started, the supercritical carbon dioxide container 3 is controlled to 40 degrees Celsius by the temperature regulator 27, whereby the liquid carbon dioxide introduced in the supercritical carbon dioxide container 3 is changed into supercritical carbon dioxide 13. The pressure is kept at 20 MPa by the back pressure regulator 25. When the carbon dioxide filling the supercritical carbon dioxide container 3 has reached a pressure of 20 MPa and a temperature of 40 degrees Celsius, filling operation terminates. The siphon-based liquid carbon dioxide container 30 is installed separately from the siphon-based liquid carbon dioxide container 9 given in FIG. 1, and can be connected through the high pressure force supply pump 7 of the siphon-based liquid carbon dioxide container 9.

Figure 5:
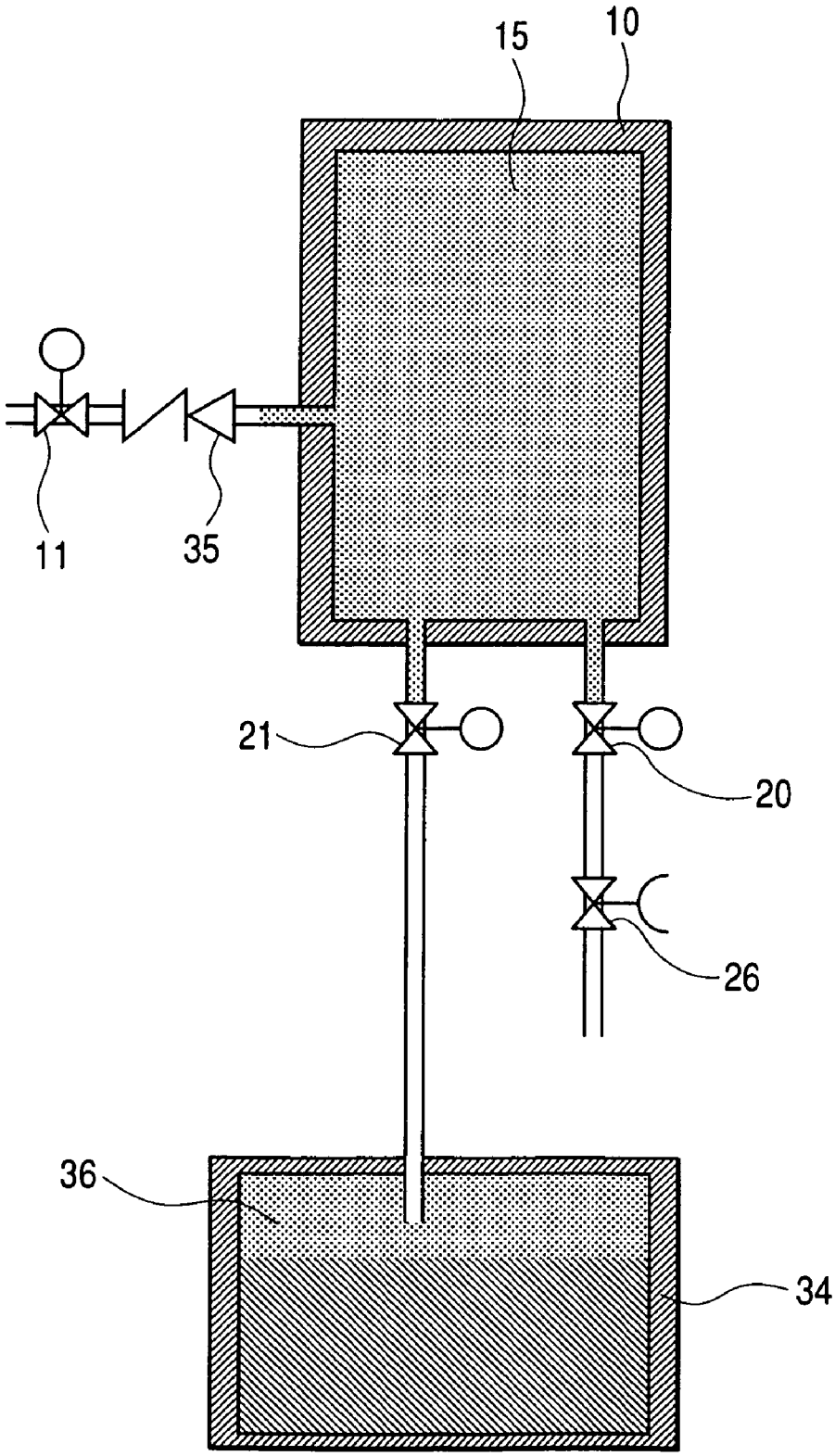
FIG. 5 is a block diagram of a resist development apparatus of the present invention, representing connection between a high pressure carbon dioxide container and a liquid carbon dioxide.

FIG. 5 is a cross sectional view representing a part of the configuration of a resist development apparatus for filling the supercritical carbon dioxide gas container with supercritical carbon dioxide gas, according to the present invention. When the valve 21 is opened, carbon dioxide gas 36 is introduced until the pressures of liquid carbon dioxide container 34 and high pressure carbon dioxide gas container 10 are equal to each other. For the liquid carbon dioxide container 34, carbon dioxide gas introduced in excess of the set pressure of 4 MPa is discharged from the back pressure regulator 26 by opening the valve 20 and the pressure is kept at 4 MPa. The liquid carbon dioxide container 34 is installed separately from the liquid carbon dioxide container 9 given in FIG. 1, and can be connected to the gaseous portion of the liquid carbon dioxide container 9.

Figure 6:
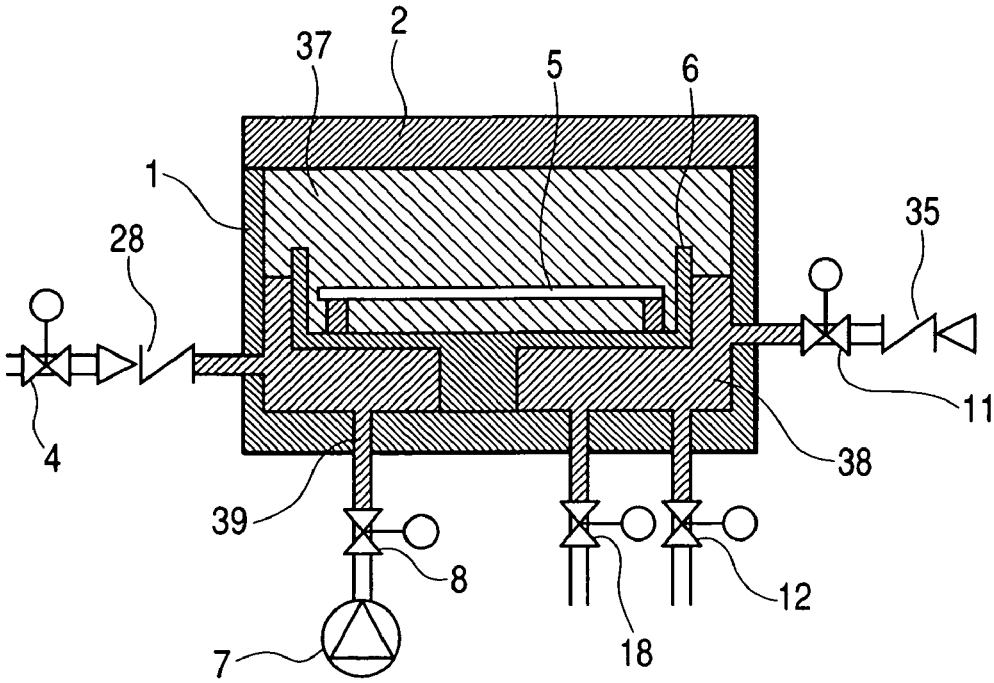
FIG. 6 is a block diagram of a resist development apparatus of the present invention, representing the state of carbon dioxide in a resist development processing chamber.
Figure 7:
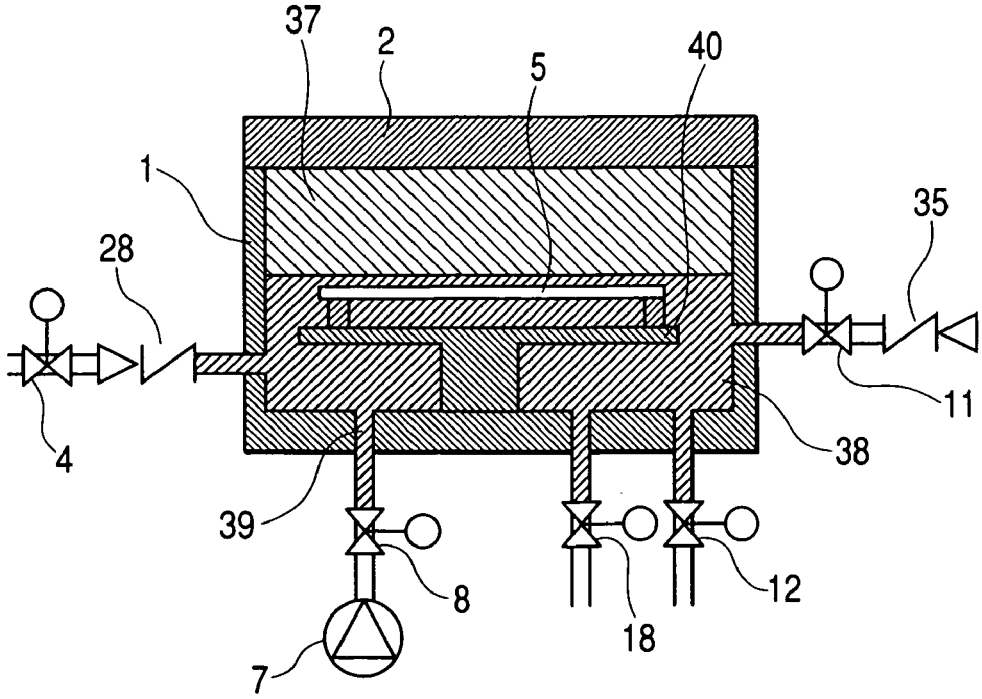
FIG. 7 is a block diagram of a resist development processing chamber as a comparative example, representing the state of carbon dioxide in the resist development processing chamber.

FIG. 6 is a schematic diagram representing the state of carbon dioxide filling the development processing chamber during resist development by the resist development apparatus according to the present invention for filling the liquid carbon dioxide container with liquid carbon dioxide. During development, liquid carbon dioxide 14 is pumped into the development processing chamber 1 from the liquid carbon dioxide inlet 39 by the high pressure force supply pump 7. Immediately after introduction, it remains in the bottom of the development processing chamber in the liquid form. If the resist substrate holder is configured in a flat plate shape as shown in FIG. 7, the resist substrate 5 is immersed in liquid carbon dioxide 38, and development out of control will occur. To prevent the resist substrate 5 from being immersed in liquid carbon dioxide 38, the resist substrate holder 6 is shaped in a cut form, as shown in FIG. 6.

Figure 3:
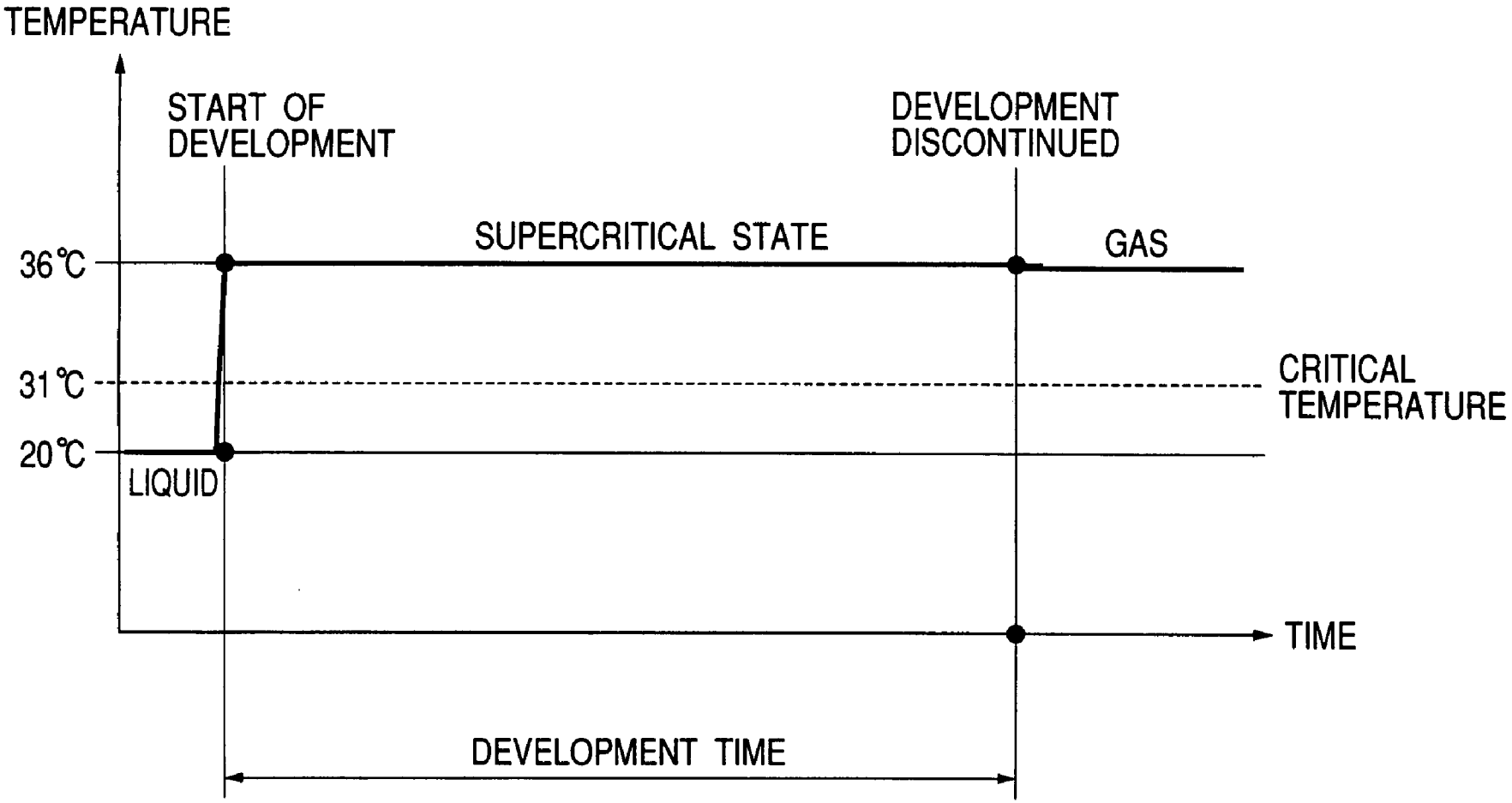
FIG. 3 is a diagram representing changes in the state of carbon dioxide in the resist development processing chamber in FIG. 1.

FIG. 3 is a diagram representing the temperature state of carbon dioxide in the development processing chamber in this case. Development is started by opening the valve 4, and is stopped by opening the valve 11. As described above, supercritical carbon dioxide is introduced into the development processing chamber and development is carried out.

Figure 2:
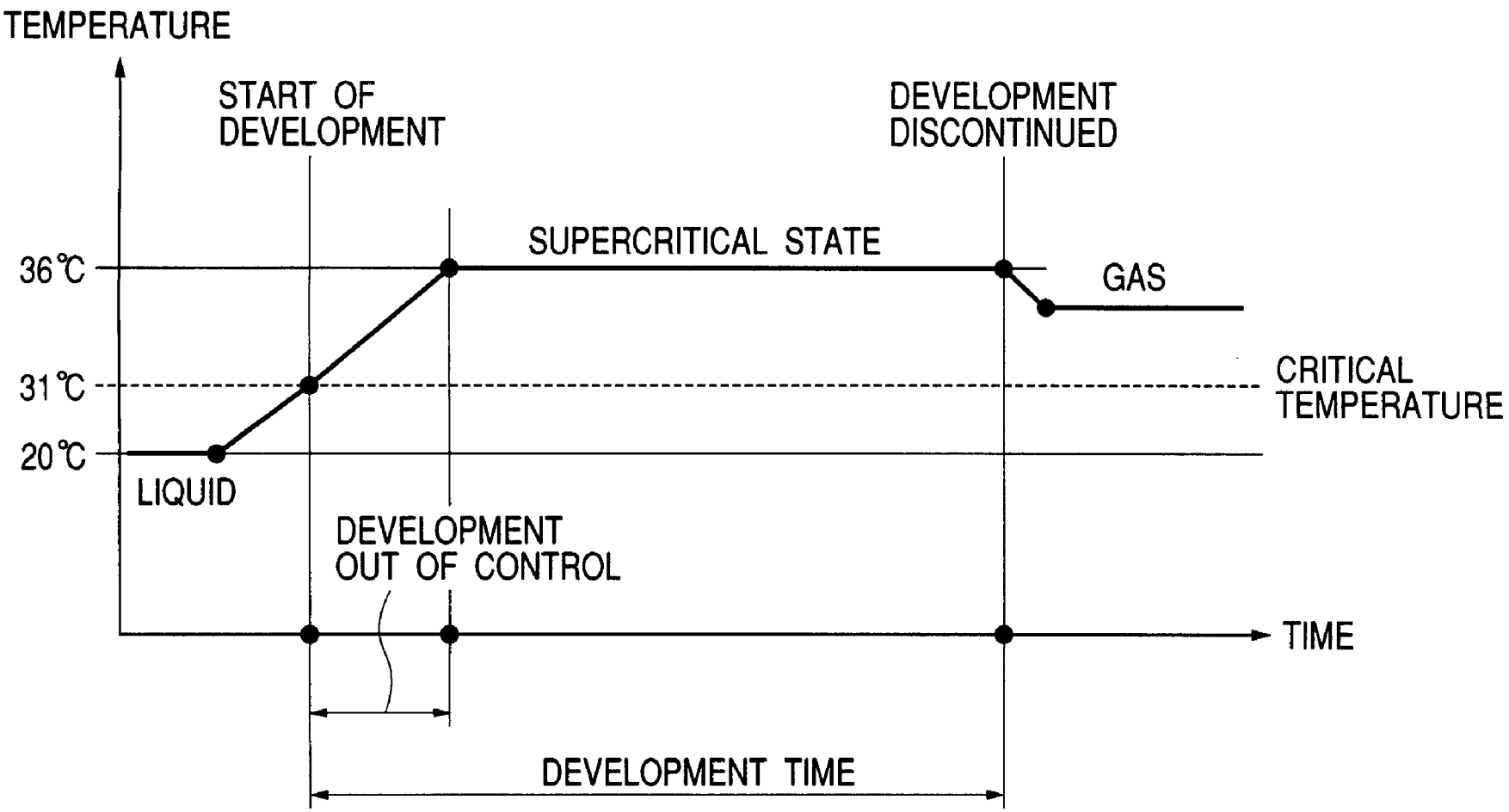
FIG. 2 is a diagram representing changes in the state of carbon dioxide in a resist development processing chamber.

When development is discontinued, the supercritical carbon dioxide is discharged in the gaseous form, whereby gaseous state is created in the development processing chamber, and development is stopped. To be more specific, much time is required to convert liquid carbon dioxide in supercritical carbon dioxide by heating the development processing chamber, as shown in FIG. 2. This gives rise to the time of development out of control. According to the present embodiment, however, such time hardly occurs. To put it another way, such time is minimized, and accurate setting of the development time is ensured according to the present embodiment, whereby the optimum development result can be obtained.

According to the present embodiment, minute resist development can be controlled under the optimum resist development conditions by using the supercritical fluid such as carbon dioxide. Especially, this allows time control of the solubility of supercritical fluid used for development, thereby providing development results free from variations.

As described above, the resist substrate coated with resist soluble in carbon dioxide such as fluorine-containing polymeric material after having been exposed can be developed by supercritical carbon dioxide. At the same time, use of a waste processing facility is eliminated since no chemical solution is used in the step of development processing.

Further, as shown in the present embodiment, no chemical solution is used in the development and rinsing steps. This eliminates the need of using a prior art drying process, and avoids minute pattern collapse—a problem in the drying process. Further, in the aforementioned step of development processing according to the prior art, a plurality of processing facilities are required in each step of cleaning and drying at least in the subsequent process. By contrast, the present embodiment allows simultaneous processing of development, cleaning and drying to be performed by one and the same development processor.

According to the present invention, a plurality of large-diameter resist substrates having a diameter of 200 mm and more can be developed simultaneously under the optimum resist development conditions, using supercritical fluid such as carbon dioxide. Especially the present invention provides time control of the solubility of the supercritical fluid used for development, and allows precise setting of development conditions.

As described above, the resist substrate coated with resist soluble in carbon dioxide such as fluorine-containing polymeric material after-having been exposed can be developed by supercritical carbon dioxide. At the same time, use of a waste processing facility is eliminated since no chemical solution is used in the step of development processing.

Further, according to the present invention, no chemical solution is used in the development and rinsing steps. This eliminates the need of using a prior art drying process, and avoids minute pattern collapse—a problem in the drying process. Further, in the aforementioned step of development processing according to the prior art, a plurality of processing facilities are required in each step. By contrast, the present invention uses only one apparatus to handle these jobs.

What is claimed is:

1. A resist development processor comprising:

a high pressure gas container for storing a high pressure gas of a development solvent, said high pressure gas container being connected to a development processing chamber through a valve; and a liquid container for storing liquid and gas of said development solvent, said liquid container being connected to said development processing chamber through a second valve, wherein said high pressure gas container is connected to said liquid container through a valve in contact with said gas of said liquid container.

2. The resist development processor according to claim 1 characterized in that said high pressure gas container is provided with a back pressure regulator for ensuring that said development solvent in a gaseous state filled into said high pressure gas container is changed into a gas by opening of said valve, without allowing a supercritical fluid in said development processing chamber to be liquefied.

3. The resist development processor according to claim 1 characterized in that said development processing chamber is connected through a high pressure force supply pump in contact with said development solvent in liquid state of said liquid container.

* * * * *